US007302771B2

(12) United States Patent
Hsu

(10) Patent No.: US 7,302,771 B2
(45) Date of Patent: Dec. 4, 2007

(54) INFLATABLE DECORATION

(75) Inventor: Sheng-Hung Hsu, Kaohsiung Hsien (TW)

(73) Assignee: Gemmy Industries Corporation, Coppell, TX (US)

( * ) Notice: Subject to any disclaimer, the term of this patent is extended or adjusted under 35 U.S.C. 154(b) by 339 days.

(21) Appl. No.: 11/184,129

(22) Filed: Jul. 18, 2005

(65) Prior Publication Data

US 2007/0033844 A1 Feb. 15, 2007

(51) Int. Cl.
*G09F 15/00* (2006.01)

(52) U.S. Cl. ..... 40/610; 40/571; 40/538; 40/541

(58) Field of Classification Search ..... 40/610, 40/571, 538, 541
See application file for complete search history.

(56) References Cited

U.S. PATENT DOCUMENTS

| | | | | |
|---|---|---|---|---|
| 2,151,333 | A * | 3/1939 | Robin | 40/480 |
| 4,261,687 | A * | 4/1981 | Gerberick | 416/117 |
| 6,626,559 | B1 * | 9/2003 | Lin | 362/249 |
| 6,644,843 | B2 * | 11/2003 | Chin-Cheng | 362/97 |
| 6,786,793 | B1 * | 9/2004 | Wang | 446/226 |
| 2006/0025037 | A1 * | 2/2006 | Lau | 446/226 |
| 2006/0037225 | A1 * | 2/2006 | Wei | 40/610 |

* cited by examiner

*Primary Examiner*—George B. Nguyen
*Assistant Examiner*—Bradley T Carpenter
(74) *Attorney, Agent, or Firm*—James H. Walters

(57) ABSTRACT

An inflatable decoration has a body, an inflator and a rotary illuminant member. The body has a tower and a seat mounted on the tower. Multiple transparent windows are respectively provided on a periphery of the seat. The inflator is mounted in a lower end of the tower to blow air into the body. The illuminant member is provided in the seat and light through the windows achieves a dynamic lighthouse effect.

6 Claims, 4 Drawing Sheets

INFLATABLE DECORATION

BACKGROUND OF THE INVENTION

1. Field of the Invention

The present invention relates to an inflatable decoration, and more particularly to an inflatable decoration with a dynamic effect.

2. Description of Related Art

At present, all kinds of inflatable decorations are displayed in or in front of supermarkets, department stores etc to attract customers and present an enjoyable atmosphere. A conventional inflatable decoration comprises a body made of fabric material and a barrel which has a seat formed on a lower end of the barrel. The body is mounted on the barrel so that the body is suspended beyond the ground. An air inlet is defined in the seat and in communication with the interior of the body, and an inflator is mounted on the seat. A vent hole is defined in the inflator and corresponds to the air inlet so that air can be blown into the body when the inflator is operating. Hence, the body erects to attract the customers.

However, the inflatable decoration is immovable without a dynamic effect and thereby customers quickly tire of this decoration.

Therefore, the invention provides an inflatable decoration to mitigate or obviate the aforementioned problems.

SUMMARY OF THE INVENTION

The main objective of the present invention is to provide an inflatable decoration with a dynamic effect.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
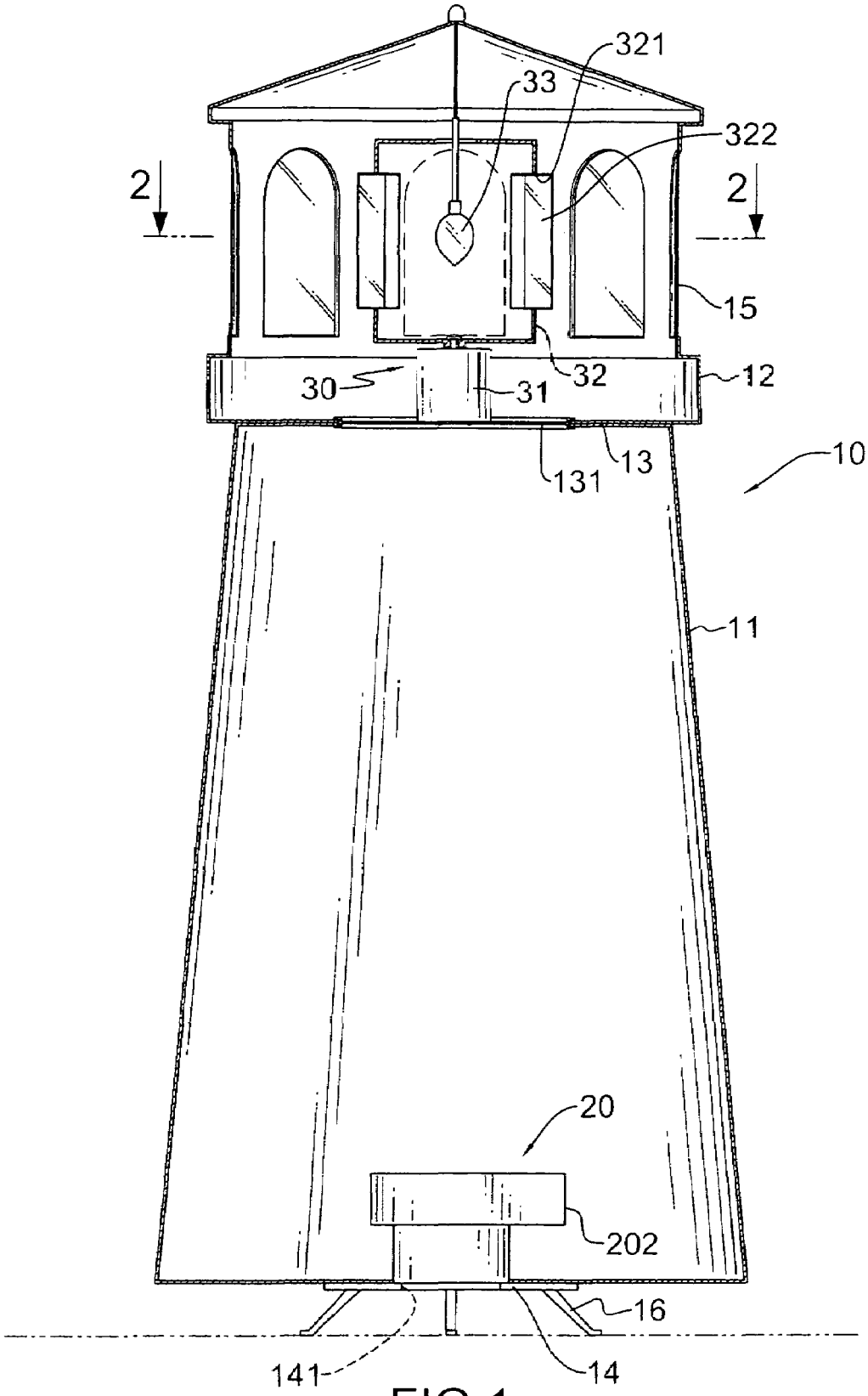
FIG. 1 is a front view of an inflatable decoration in accordance with the present invention.
Figure 2:
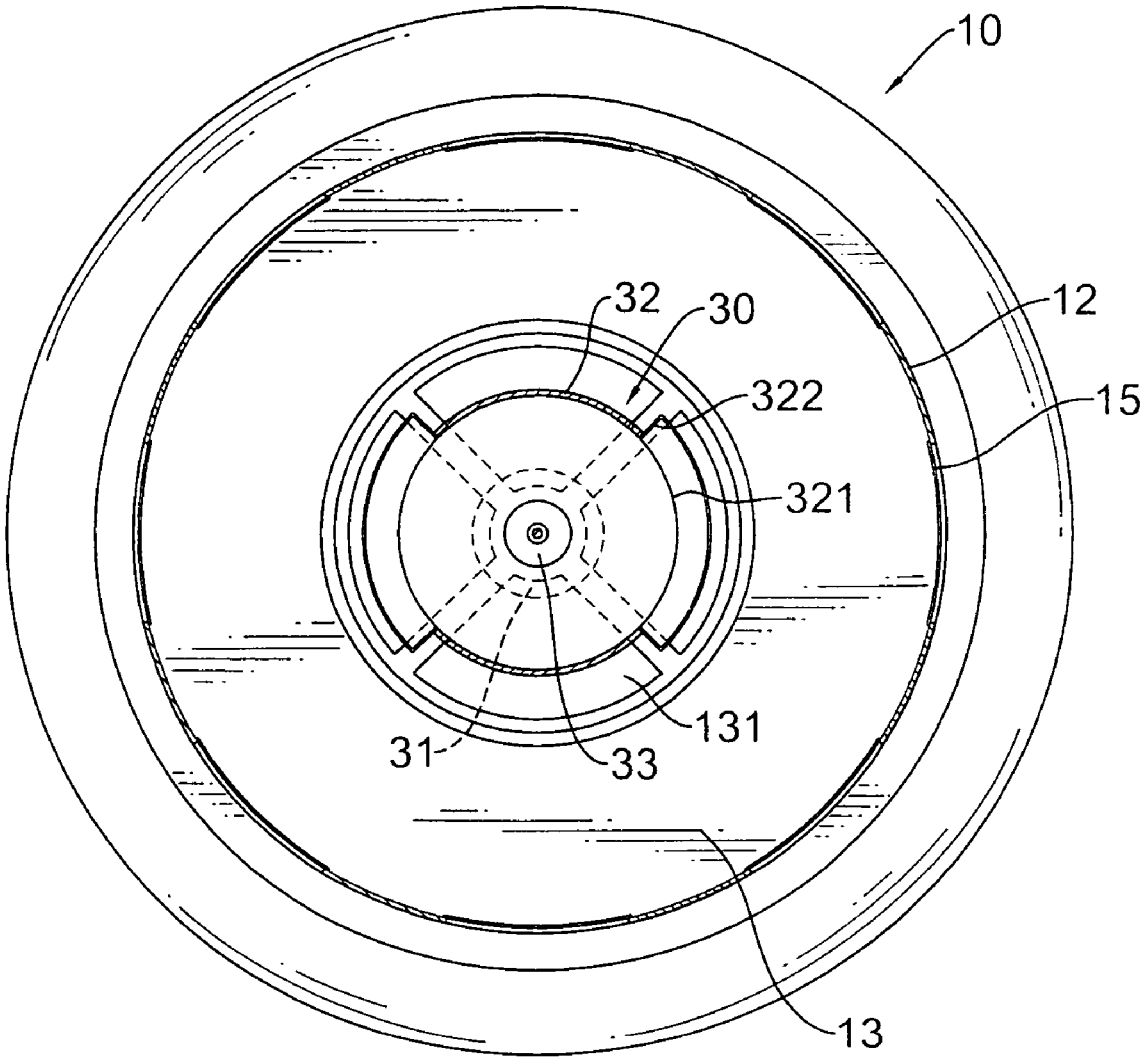
FIG. 2 is a top view of the inflatable decoration in accordance with the present invention.

With reference to FIGS. 1-2, an inflatable decoration comprises a body (10), an inflator (20) and an illuminant member (30).

The body (10) is made of fabric material and has a tower (11) and a seat (12) formed on a top end of the tower (11). A disk (13) is horizontally mounted between the tower (11) and the seat (12) and has at least one vent hole (131) defined therein so that the tower (11) is in communication with the seat (12). The tower (11) is mounted on a base (14) which has at least one air inlet (141). The at least one air inlet (141) is in communication with the interior of the body (10) and multiple feet (16) are respectively provided below the base (14) thereby preventing the air inlet (141) from being blocked. Multiple windows (15), through which the light can pass are respectively mounted on a periphery of the seat (12).

The inflator (20) such as an air blower, is provided on the base (14) and mounted in the interior of the body (10). The at least one air inlet (141) is in communication with at least one air outlet (202) of the inflator (20) so that the air can be blown into the body (10) via the air inlet (141) when the inflator (20) is operating.

The illuminant member (30) is provided in an interior of the seat (12) and has a motor (31), a hollow barrel (32) and a light source (33). The motor (31), an axle of which erects upwardly, is mounted in the interior of the seat (12) and securely provided on the disk (13). The barrel (32) is mounted on the axle so that the barrel (32) can be driven to rotate when the motor (31) is operating. Two opposed portions of the hollow barrel (32) are made of opaque material and two evenly-spaced second transparent windows (321), provided on a periphery of the barrel (32) and each second window (321) is mounted between the two portions of the barrel (32). Two reflecting boards (322) are respectively mounted on two opposed sides of each second window (321) and opposed to each other in an axial direction of the barrel (32). The light source (33) such as an electric bulb, lamp or LED, is securely mounted in the seat (12) and is not moveable with the barrel (32). In this preferred embodiment of the present invention, the light source (33) is an electric bulb connected to an electricity supply such as a main supply or a battery.

Figure 3:
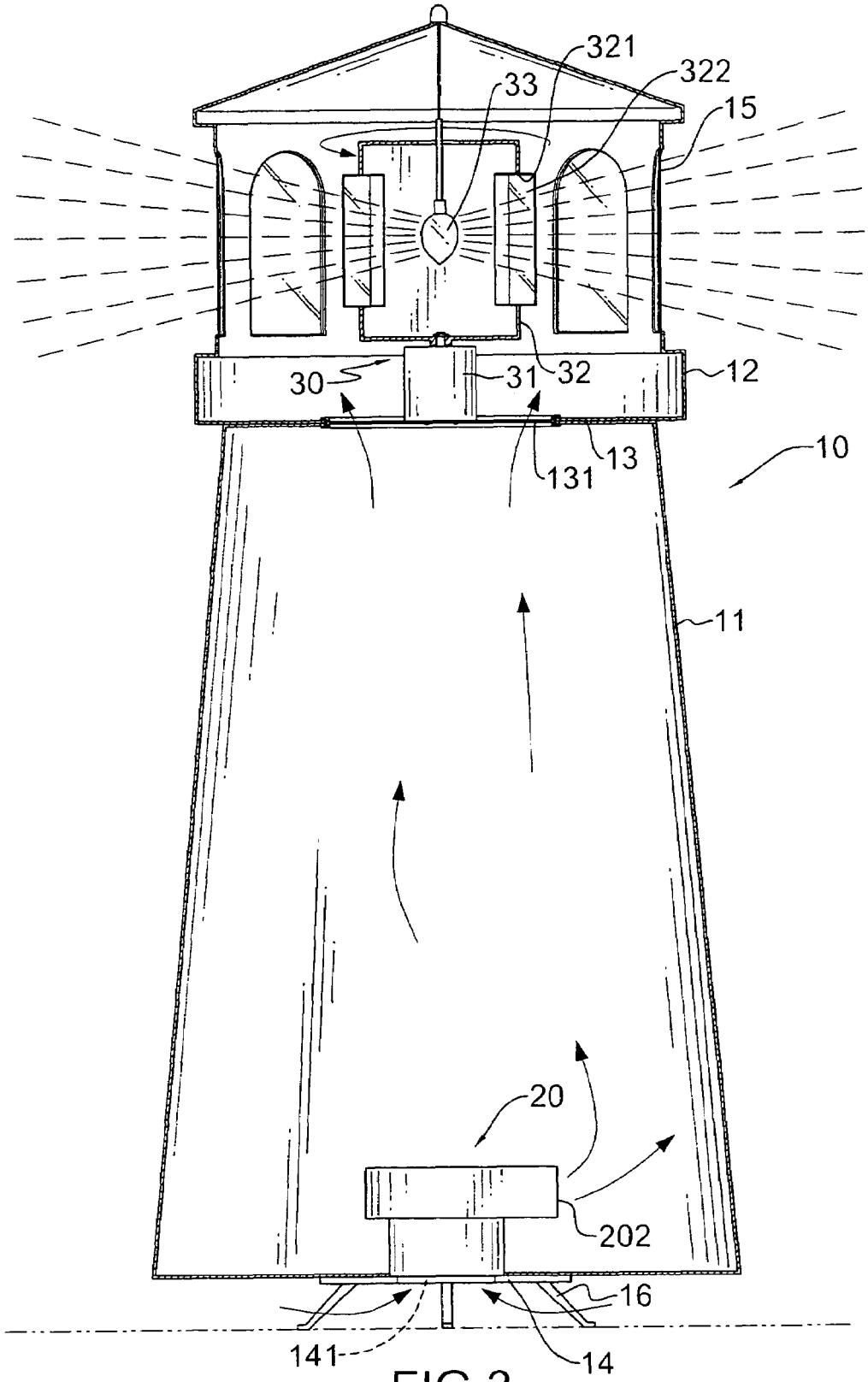
FIG. 3 is a front view of the inflatable decoration in accordance with the present invention in usage.
Figure 4:
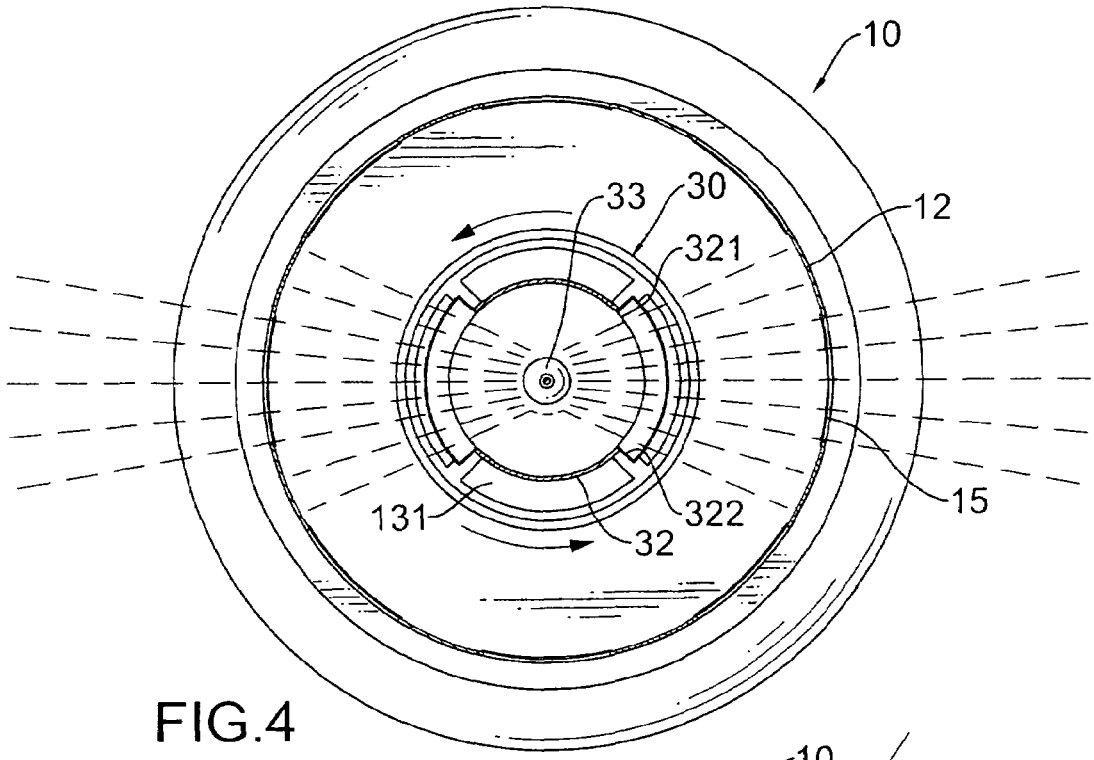
FIG. 4 is a top view of the inflatable decoration in accordance with the present invention in usage.
Figure 5:
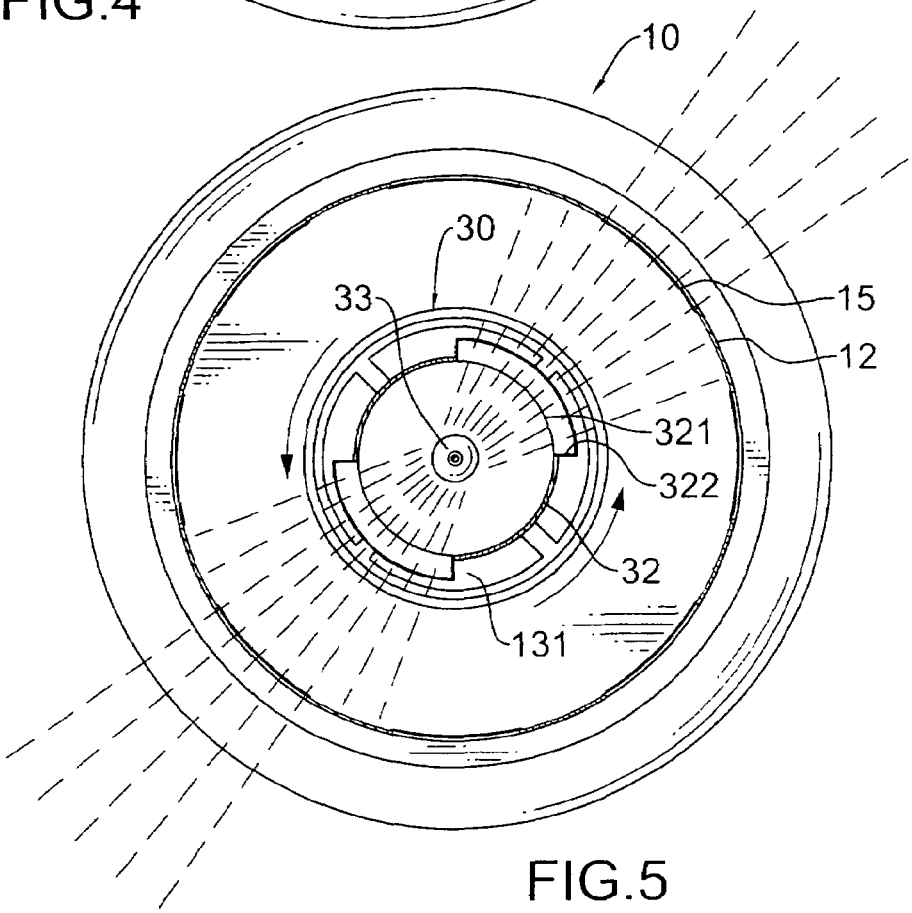
FIG. 5 is a top view of the inflatable decoration in accordance with the present invention in usage.

With reference to FIGS. 3-5, the air is blown into the body (10) via the at least one air inlet (141) and the at least one vent hole (131) when the inflator (20) operates and therefore, the inflatable decoration expands to erect. Furthermore, the barrel (32) rotates due to the rotation of the axle of the motor (31) so that the second windows (321) rotate relative to the light source (33). With the reflecting boards (322), the light strength is increased. Hence, by passing through the first and the second windows (15, 321), the light source (33) radiates and seems to rotate relative to the tower (11) thereby achieving a dynamic effect to increase the attractiveness.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An inflatable decoration comprising:

a body (10) having a tower (11) and a seat (12) formed on the tower (11), a disk (13) mounted between the tower (11) and the seat (12) and having at least one vent hole (131) defined in the disk (13), multiple first windows (15) mounted in a periphery of the seat (12), a base (14) provided on a periphery of the tower (11), and at least one air inlet (141) defined in the base (14) and in communication with an interior of the body (10);

an inflator (20) having at least one air outlet (202) defined therein and the at least one air outlet (202) in communication with the at least one air inlet (141); and an illuminant member (30) provided in the interior of the seat (12) and having a motor (31), a hollow barrel (32) mounted on an axle of the motor (31), and a light source (33) provided in the interior of the barrel (32).

2. The inflatable decoration as claimed in claim 1, wherein the hollow barrel (32), which is made of opaque material, has multiple second transparent even-spaced windows (321) formed on a periphery thereof whereby light can pass into the barrel (32), and two reflecting boards (322) are respectively mounted on two opposed sides of each second window (321).

3. The inflatable decoration as claimed in claim 2, wherein the quantity of the second windows (321) is two and the two even-spaced second windows (321) are respectively provided in two opposed sides of the barrel (32).

4. The inflatable decoration as claimed in claim 1, wherein the base (14) is mounted under the tower (11) and multiple feet (16) are respectively mounted under the base (14).

5. The inflatable decoration as claimed in claim 4, wherein the inflator (20) is provided on the base (14) and in the interior of the body (10), the at least one air outlet (202) of the inflator (20) is in communication with the at least one air inlet (141).

6. The inflatable decoration as claimed in claim 5, wherein the motor (31) is mounted on the disk (13).

* * * * *